United States Patent [19]

Küpfer et al.

[11] 4,426,809

[45] Jan. 24, 1984

[54] REACTOR FOR GASIFYING SOLID FUELS

[75] Inventors: Hans Küpfer, Frankfurt am Main; Paul Rudolph, Bad Homburg, both of Fed. Rep. of Germany

[73] Assignee: Metallgesellschaft Aktiengesellschaft, Frankfurt am Main, Fed. Rep. of Germany

[21] Appl. No.: 349,875

[22] Filed: Feb. 18, 1982

[30] Foreign Application Priority Data

Mar. 5, 1981 [DE] Fed. Rep. of Germany ..... 3108213

[51] Int. Cl.[3] ..... C10J 3/30

[52] U.S. Cl. ..... 48/86 R; 48/71; 48/72; 48/87; 48/200; 48/201

[58] Field of Search ..... 48/200, 201, 202, 206, 48/63, 86 R, 87, 71, 72, 73; 252/373

[56] References Cited

U.S. PATENT DOCUMENTS

| | | | |
|---|---|---|---|
| 813,600 | 2/1906 | Trump | 48/86 R |
| 1,649,640 | 11/1927 | Yard et al. | 48/200 |
| 4,052,173 | 10/1977 | Schultz | 48/202 |

FOREIGN PATENT DOCUMENTS

| | | | |
|---|---|---|---|
| 53184 | 9/1942 | Netherlands | 48/86 R |
| 27930 | 5/1917 | Norway | 48/200 |
| 1435089 | 5/1976 | United Kingdom | 48/202 |

*Primary Examiner*—Robert L. Lindsay, Jr.

*Attorney, Agent, or Firm*—Sprung, Horn, Kramer & Woods

[57] ABSTRACT

Solid fuels are gasified in a fixed bed with gasifying agents passed through the fixed bed from below. The gasification residues are withdrawn as solid ash or as liquid slag under the fixed bed. The reactor is charged with solid fuels through a lock chamber and with tar through a supply conduit. The tar is delivered to the fuel in numerous individual streams, which are distributed over the cross-section of the fixed bed.

In the gasifying reactor, an inclined distributor surface is disposed over the fixed bed and has numerous passage openings for the tar and the solid fuels. The outlet end of the tar supply conduit is directed to the upper portion of the distributor surface. A tar tub having outlet openings is associated with the distributor surface and serves to receive the tar. The distributor surface is rotatable on a vertical axis.

5 Claims, 1 Drawing Figure

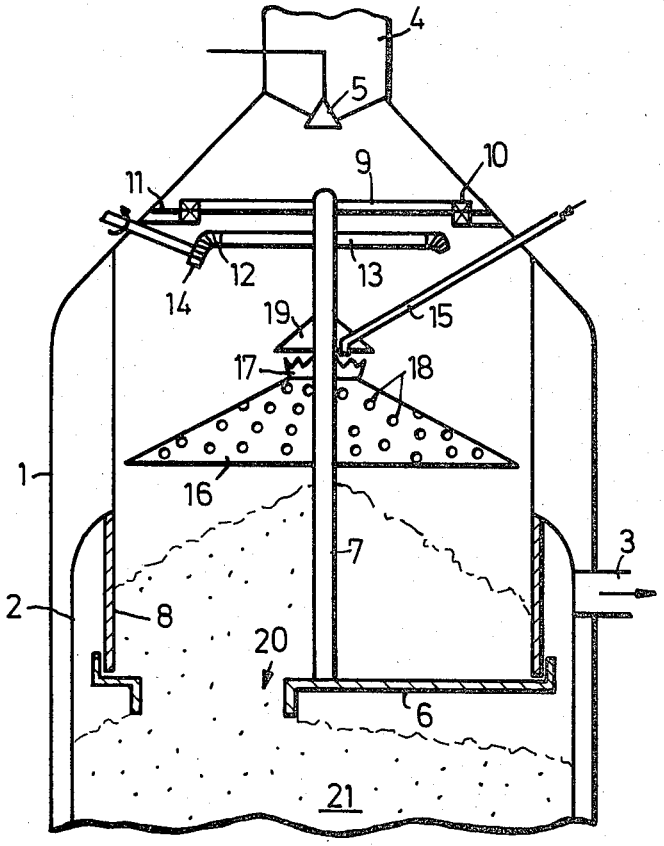
4
5
9
10
11
12
13
14
15
19
17
18
1
16
7
3
2
8
20
6
21

REACTOR FOR GASIFYING SOLID FUELS

This invention relates to a process of gasifying solid fuels in a fixed bed with oxygen, steam and/or carbon dioxide as gasifying agents passed through the fixed bed from below, wherein the gasification residues are withdrawn under the fixed bed as solid ash or liquid slag and the fixed bed is charged with solid fuels through a lock chamber and with tar through a supply conduit, and to a reactor for carrying out the process.

The solid fuels wich can be gasified consist mainly of pit coal or brown coal and will be described simply as "coal" hereinafter. Coal-containing shaped bodies, such as briquettes or pellets, may also be charged to a fixed bed for gasification. In order to ensure an adequate distribution of gas in the fixed bed, the reactor is preferably fed with granular coal in particle sizes of 3 to 70 mm or with shaped bodies having similar particle sizes.

The gasification of coal in a fixed bed is known and has been described, e.g., in Ullmanns Enzyklopädie der technischen Chemie, 4th edition (1977), vol. 14, pages 383–386. Details of the gasifying process in which the ash remains solid are apparent from U.S. Pat. Nos. 3,540,867 and 3,854,895. The gasification with a withdrawal of liquid slag has been explained in British Pat. Nos. 1,507,905; 1,508,671 and 1,512,677.

A fixed bed for gasification may be fed with coal and with a certain proportion of tar, preferably with a tar which has become available as a result of the cooling of the product gas obtained by the gasification. Particularly the dust-containing tar fraction which is thus produced can hardly be used as such and is preferably recycled to the gasifying reactor. Such process has been described in German Offenlegungsschrift No. 26 07 745 and the corresponding U.S. Pat. No. 4,187,080. In the known process, the coal to be gasified is supplied with the tar at a single point through a conduit. However, this does not result in a satisfactory mixing of tar and coal.

It is an object of the invention to ensure that the tar fed into the reactor will be mixed as homogeneously as possible with the coal which is to be gasified at the same time so that the gasifying process in the reactor proceeds more uniformly. On the other hand, a non-uniform charging of the tar results in an irregular operation of the reactor and to a channeling in the fixed bed of fuel.

In the process described first hereinbefore this object is accomplished in that the tar is delivered to the fuel in numerous individual streams, which are distributed over the cross-section of the fixed bed. In one embodiment of the invention, an inclined distributor surface having numerous passage openings for the tar and the solid fuel is disposed over the fixed bed and the outlet end of the tar supply conduit is directed to the upper portion of the distributor surface. The tar flows first down on the distributor surface and then in numerous individual currents through the openings of the distributor surface. The coal pile under the distributor surface is thus uniformly supplied with tar.

Instead of the distributor surface, one or more nozzles may be provided at the outlet end of the tar supply conduit. However, the outlet openings of distributing nozzles may be clogged. The tar which is usually subjected to gasification contains solids, such as fine-grained coal. For this reason special care must be taken to ensure a free flow of the tar through the distributing openings.

There is no risk of clogging if an inclined distributor surface is used rather than nozzles and the tar coming from a conduit flows over said distributor surface. The tar jet emerging from the supply conduit can be distributed as uniformly as possible by means of a distributor surface in various ways. For instance, the distributor surface can be constituted by a distributor cone. This improves the distribution over the cross-section of the reactor. The distributor cone or other distributor surface may be associated with a tub for receiving the tar which is to be distributed. A primary distribution of the tar is effected as the tar is discharged from the tube. Thereafter, the tar is distributed further as it flows down on the distributor cone or other distributor surface. The distributor cone or other distributor surface may be movable and specifically may be rotatable on a vertical axis.

BRIEF DESCRIPTION OF DRAWING

An embodiment of the invention is diagrammatically shown on the drawing, which is a longitudinal sectional view showing the upper portion of the gasifying reactor.

DESCRIPTION OF SPECIFIC EMBODIMENT

The reactor comprises a water-cooled double jacket 1, 2 and a product gas outlet 3. From a lock chamber 4 at the top end of the reactor, a batch of coal to be gasified falls into the reactor whenever the valve 5 is opened. The coal falls first onto a rotary disk 6, which is secured to a vertical shaft 7. The pile of coal on the rotary disk is laterally supported by a stationary cylinder 8. The shaft is supported by spokes 9 and a bearing ring 10 on a stationary bearing ring 11.

The shaft 7 can be rotated on its longitudinal axis and for this purpose carries a gear 12, which has spokes 13 and is in mesh with a pinion 14. The latter is connected to drive means, disposed outside the reactor, by means which are not shown.

Tar to be gasified is charged to the reactor through the tar supply conduit 15. To ensure a uniform distribution of the tar to the coal pile on the rotary disk 6, an umbrella-like distributor cone 16 is provided with a tar tub 17 and secured to the shaft 7. The tar tub 17 is open-topped and has a serrated rim, as is shown on the drawing. Between the teeth of said rim, the tar which has been received by the tub 16 flows outwardly onto the distribution cone 16. The diameter of these openings is larger than the largest coal particles to be gasified. The diameter of the openings is usually in the range of 100 to 300 mm.

The shape and size of the openings 18 may vary widely as the openings serve mainly for the passage of coal which falls onto the cone 16 from above and to permit also a flow of tar through the openings. The tar is additionally distributed in that the cone 16 and the tub 17 are rotated by the shaft 7 during the operation of the reactor. Over the tar tub 17, which is connected to the shaft 7, a hood 19 is provided, which ensures that coal charged from above will not fall into the tub 17. The coal on the rotary disk 6 and the tar which has been uniformly distributed into the coal flow through a short passage 20 in the rotary disk downwardly onto the fixed bed 21 for gasification. The rotary disk 6 may be omitted so that the coal and the tar from the distributor cone 16 falls directly onto the fixed bed 21.

What is claimed is:

1. In a reactor for gasifying solid fuels in a fixed bed with oxygen, steam, carbon dioxide or mixtures thereof as gasifying agents which reactor is provided with means for inserting said gasifying agent from a position below solid fuel therein to be gasified, means for withdrawing gasification residues under a fixed bed of solid fuel within said reactor as solid ash or liquid slag and means for charging the fixed bed of solid fuel with solid fuel to be gasified via a lock chamber and means for introducing tar to said solid fuel via a tar supply conduit, the improvement wherein below said tar supply conduit there is an inclined distributor surface having a plurality of openings, and on top of said distributor surface there is a tar tub having outlet openings, said tar tub being in fluid communication with said tar supply conduit, whereby when tar is supplied via said tar supply conduit to said tar tub it is caused to overflow said tar tub at a plurality of points, the tar from said tar tub flows onto said inclined distributor surface and said tar flowing on said distributor surface is divided into a plurality of individual streams flowing through the openings of said distributor surface.

2. A reactor according to claim 1, wherein said distributor surface comprises a distributor cone.

3. A reactor according to claim 1, wherein said distributor surface is rotatable on a verticle axis and said reactor comprises means for rotating said vertical axis.

4. A reactor according to claim 3, further comprising a coal-distributing disk secured to said vertical shaft and rotatable with said distributor surface.

5. A reactor according to claim 1, wherein said tar tub has upwardly protruding teeth whereby to define openings between the apexes of said teeth such that when the tar is caused to overflow said tar tub, the tar is formed into individual streams and as such is passed over said incline distributor surface.

* * * * *